US005743386A

United States Patent [19]

Liao

[11] Patent Number: 5,743,386

[45] Date of Patent: Apr. 28, 1998

[54] MEMBRANE SWITCH ASSEMBLY

[75] Inventor: Pin-Chien Liao, Taoyuan, Taiwan

[73] Assignee: Acer Peripherals, Inc., Taiwan

[21] Appl. No.: 682,491

[22] Filed: Jul. 17, 1996

[51] Int. Cl.[6] ..... H01H 1/10

[52] U.S. Cl. ..... 200/512; 200/239

[58] Field of Search ..... 200/512, 516, 200/517, 518, 239, 341, 513, 514, 515

[56] References Cited

U.S. PATENT DOCUMENTS 4,684,767 8/1987 Phalen ..... 200/512

4,700,025 10/1987 Hatayama et al. ..... 200/512

5,149,923 9/1992 Demeo ..... 200/512

*Primary Examiner*—David J. Walczak

[57] ABSTRACT

A membrane switch including a rubber dome, an insulation layer, a membrane and an electric-conductive support plate is provided. The membrane switch is ON as the pair of non-contacting circuit leads is forced to contact with the support plate due to the force applied on the rubber dome. As the rubber dome is free of an external force, the pair of non-contacting circuit leads is spaced from the support plate, resulting in an OFF state of the membrane switch.

8 Claims, 3 Drawing Sheets

FIG. 1A
PRIOR ART
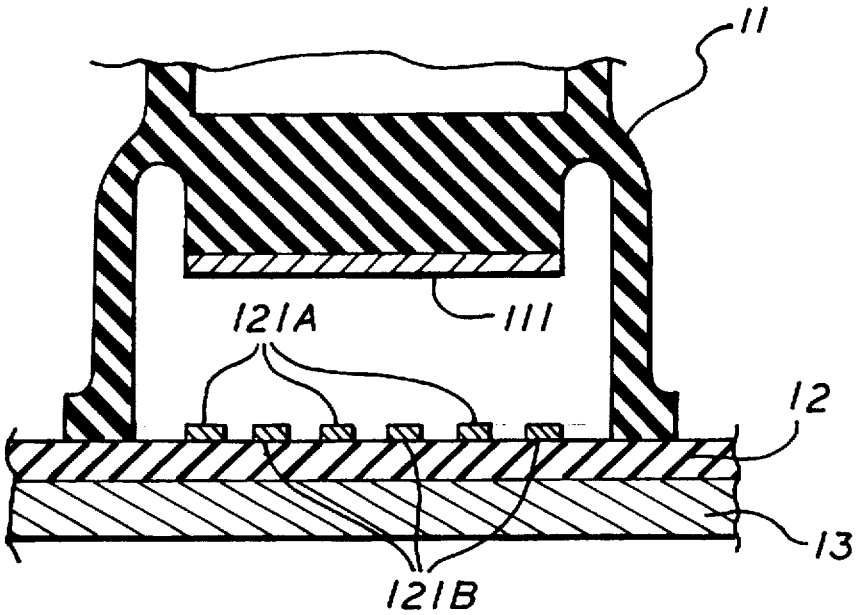
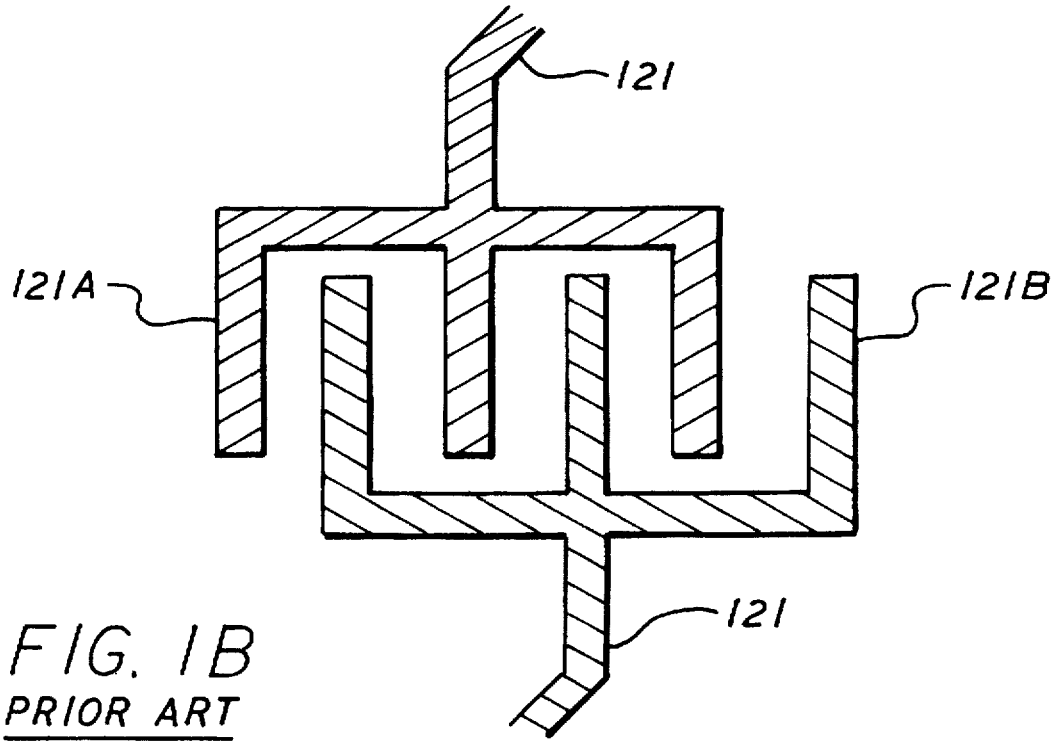
FIG. 1B
PRIOR ART

FIG. 2A
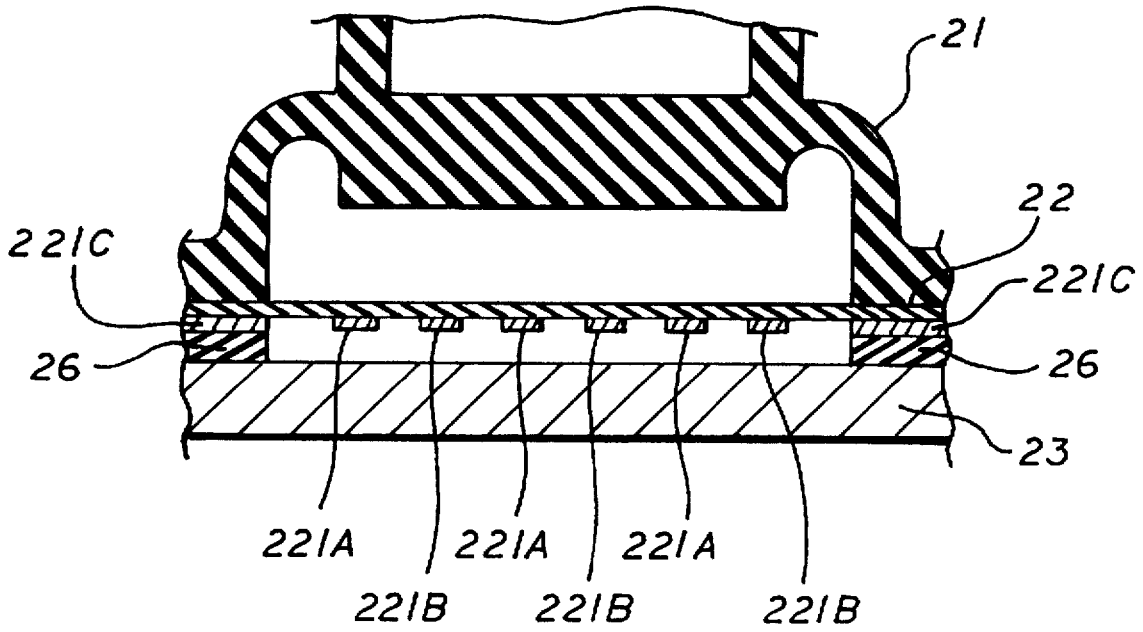
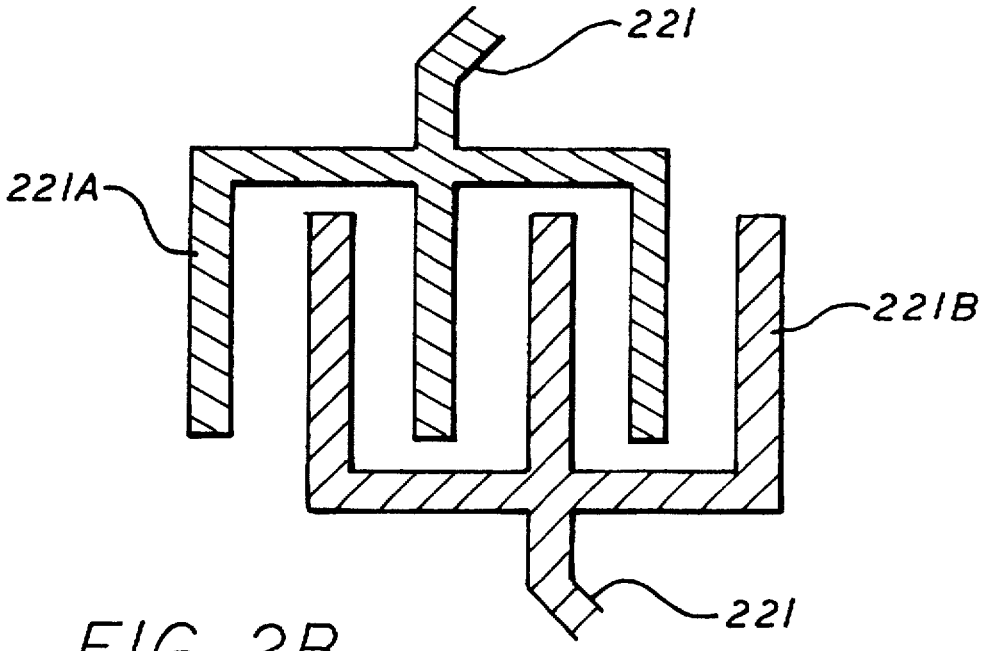
FIG. 2B

MEMBRANE SWITCH ASSEMBLY

TECHNICAL FIELD OF INVENTION

The invention relates to a membrane switch formed on a single membrane mylar.

BACKGROUND OF INVENTION

The membrane switch has been widely used in the input device of electrical instruments, e.g., keyboard of portable personal computer. One conventional membrane switch, as shown in FIG. 1, includes a rubber dome 11, a support plate 13, a membrane mylar 12, a conductive-pad 111 and a circuit pattern 121 with a pair of non-contacting circuit leads 121A and 121B printed on the membrane mylar 12. As an external force is applied on the rubber dome 11 causing its downward deformation, the conductive-pad 111 contacts with the pair of non-contacting circuit leads 121A and 121B thereby turning ON the membrane switch. Mylar is the commercial name of the polymer material used as the membrane 12 and that is well known to persons skilled in arts.

Two major drawbacks have been observed with regard to the prior art of FIG. 1. First of all, the electric conductivity of the conductive-pad 111 may gradually attenuate due to numbers of operation, oxidation effect, sulfuration effect of the conductive-pad 111 or environment effects, etc. Secondly, a layer of the conductive-pad 111 must be provided on the corresponding inner surface of the rubber dome 11 that is an extra process and costs more.

To resolve the drawbacks and higher cost mentioned above, the function of the membrane switch is achieved by the instant invention without additional process.

SUMMARY OF INVENTION

A membrane switch assembly comprises an electric-conductive support plate, a membrane and a rubber dome.

The membrane has a bottom surface printed with a circuit pattern. The rubber dome is disposed on the membrane to actuate the membrane switch assembly. The membrane switch is ON as the pair of non-contacting circuit leads is forced to contact with the support plate due to the force applied on the rubber dome. As the rubber dome is free of an external force, the pair of non-contacting circuit leads is spaced from the support plate.

BRIEF DESCRIPTION OF THE DRAWINGS

FIG. 1(A) illustrates the sectional view of a conventional membrane switch. FIG. 1(B) illustrates the plane view of the pair of non-contacting circuit leads 121A, 121B and circuit pattern 121.

FIG. 2(A) illustrates one embodiment of the invention in sectional view.

FIG. 2(B) illustrates the plane view of the pair of non-contacting circuit leads 221A, 221B and circuit pattern 221 of FIG. 2(A).

DETAILED DESCRIPTIONS OF THE PREFERRED EMBODIMENT

Figure 3:
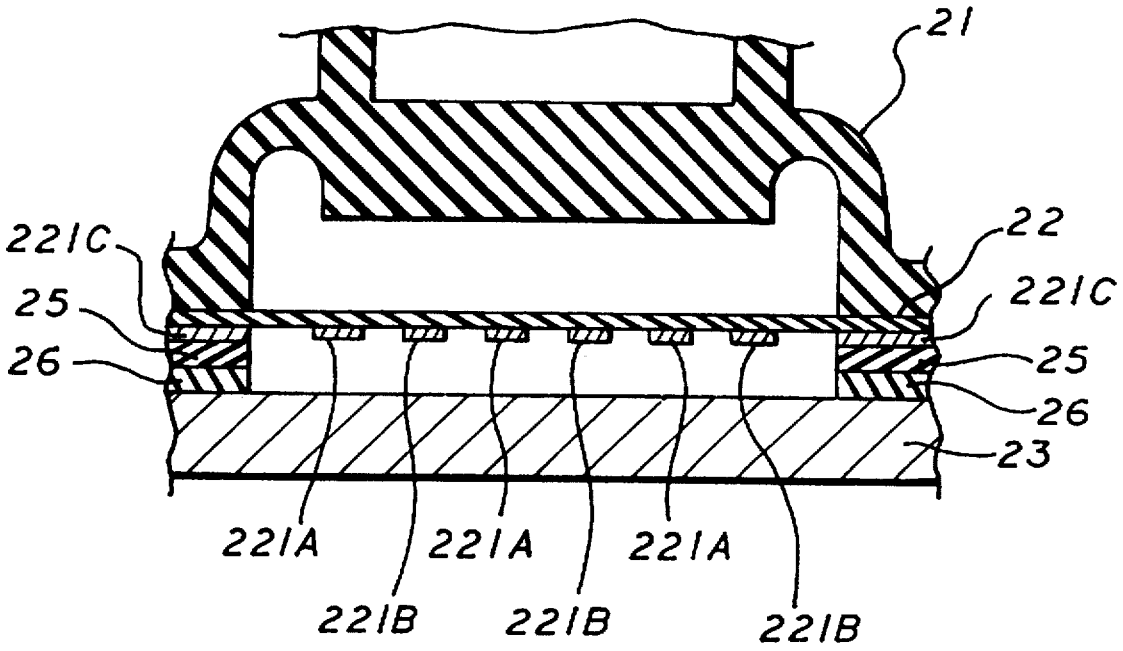
FIG. 3 illustrates another embodiment of the invention in sectional view.

As shown in FIG. 2, the membrane switch of the instant invention comprises a rubber dome 21, an electric-conductive support plate 23, a membrane mylar 22, a bottom conductive circuit pattern 221, which includes portions 221A, 221B and 221C shown, printed on the bottom of membrane mylar 22. The portions 221A, 221B constitute a pair of non-contacting circuit leads of the circuit pattern 221. In addition, insulator printings 26 is printed over the conductive circuit layer 221C for providing insulation purpose and minimum required height of the membrane switch. The thickness of the insulation layer 26 depends on the inner diameter of rubber dome 21 and the bounce speed of the switch. Typically, the thickness of insulation layer 26 varies from 0.04 mm to 0.110 mm. The top view of the circuit pattern 221 may be one shown in FIG. 2(B). The membrane switch is ON as the pair of circuit leads 221A, 221B are forced to contact the electric-conductive support plate 23 due to the force applied on the rubber dome 21. As the rubber dome 21 is freed of an external force, the pair of circuit lead 221A, 221B become spaced from the support plate 23 resulting in an OFF state of the membrane switch.

As shown in FIG. 3, the other embodiment of the instant invention comprises a rubber dome 21, an electric-conductive support plate 23, a membrane mylar 22, a bottom conductive circuit pattern 221, which includes portions 221A, 221B and 221C shown, printed on the bottom of membrane mylar 22. The portions 221A, 221B constitute a pair of non-contacting circuit leads of the circuit pattern 221. Furthermore, a printing layer 25 is provided over the circuit layer 221C to meet the minimum required height of the membrane switch. This printing layer 25 may be either conductive material or non-conductive material. Over the printing layer 25, an insulator printings 26 is thereafter printed for providing insulation purpose. The total thickness of the insulation layer 26 and layer 25 depends on the inner diameter of rubber dome 21 and the bounce speed of the switch. Typically, the total thickness of insulation layer 26 and layer 25 varies from 0.04 mm to 0.110 mm. The top view of the circuit pattern 221 may be one shown in FIG. 2(B). The membrane switch is ON as the pair of circuit leads 221A, 221B are forced to contact the electric-conductive support plate 23 due to the force applied on the rubber dome 21. As the rubber dome 21 is freed of an external force, the pair of circuit leads 221A, 221B are spaced from the support plate 23 resulting in an OFF state of the membrane switch.

As well known in the arts, the circuit pattern is layer of conductive material, e.g., silver, silver/graphite mixture, in paste form which are printed on the membrane first and then dried under an adequate temperature. It is well known that finger array is formed on predetermined boundary of the membrane mylar which acts as interface with other electric device, e.g., connector of the computer's system bus. The production of finger array of the membrane switches assembly usually needs a print process of carbon layer or graphite layer and, during the print process, the carbon or graphite printings 25 is printed which requiring no additional process. To enhance the reliability, in typical, a layer of di-electric paint is usually provided on the bottom of the membrane mylar 22 to avoid short circuit between the printed circuits or between printed circuits and conductive support plate 23, except areas encompassing the circuit pattern and a pair of non-contacting circuit leads 221A and 221B. Therefore, the insulator printing 26 is printed during the print process of the di-electric paint.

What is claimed is:

1. A membrane switch assembly including at least N membrane switches, N being a whole number that is 2 or greater, comprising:

a single electric-conductive support plate;

a membrane having a bottom surface printed with a circuit pattern including at least N pairs of non-contacting circuit leads, each pair of non-contacting circuit leads corresponding to one of said N membrane switches;

at least N rubber domes each having an actuator disposed on said membrane to actuate one of said corresponding membrane switches;

an insulating layer on a predetermined area of said circuit pattern in contact with said single electric-conductive support plate;

wherein each of said membrane switches is ON as its corresponding pair of non-contacting circuit leads is forced to contact said single electric-conductive support plate due to an external force applied on said corresponding rubber dome, and, as said corresponding rubber dome is freed of an external force, said corresponding pair of non-contacting circuit leads becomes spaced from said single electric-conductive support plate resulting in an OFF state of said corresponding membrane switch.

2. The membrane switch assembly as recited in claim 1, wherein said insulating layer is printed on a predetermined area of said circuit pattern.

3. The membrane switch assembly as recited in claim 1, wherein said insulating layer is formed from a polymer material.

4. A membrane switch assembly including at least N membrane switches, N being a whole number that is 2 or greater, comprising:

a single electric-conductive support plate;

a membrane having a bottom surface printed with a circuit pattern including at least N pairs of non-contacting circuit leads, each pair of non-contacting circuit leads corresponding to one of said N membrane switches;

at least N rubber domes each having an actuator disposed on said membrane to actuate one of said corresponding membrane switches;

a printing layer on a predetermined area of said circuit pattern;

an insulating layer between said printing layer and said single electric-conductive support plate;

wherein each of said membrane switches is ON as its corresponding pair of non-contacting circuit leads is forced to contact said single electric conductive support plate due to an external force applied on said corresponding rubber dome, and, as said corresponding rubber dome is freed of an external force, said corresponding pair of non-contacting circuit leads becomes spaced from said single electric-conductive support plate resulting in an OFF state of said corresponding membrane switch.

5. The membrane switch assembly as recited in claim 4, wherein said insulating layer is printed on said printing layer.

6. The membrane switch assembly as recited in claim 4, wherein said insulating layer is formed from a polymer material.

7. The membrane switch assembly as recited in claim 4, wherein said printing layer is formed from a nonconductive material.

8. The membrane switch assembly as recited in claim 4, wherein said printing layer is formed from conductive material.

* * * * *